United States Patent [19]

Sasaki et al.

[11] Patent Number: 4,498,957

[45] Date of Patent: Feb. 12, 1985

[54] AROMATIC POLYAMIDE PAPER-LIKE SHEET AND PROCESSES FOR PRODUCING THE SAME

[75] Inventors: Hideharu Sasaki; Keizo Shimada, both of Iwakuni, Japan

[73] Assignee: Teijin Limited, Osaka, Japan

[21] Appl. No.: 532,304

[22] Filed: Sep. 15, 1983

Related U.S. Application Data

[63] Continuation of Ser. No. 341,540, Jan. 21, 1982, abandoned, which is a continuation of Ser. No. 144,341, Apr. 28, 1980, abandoned.

[30] Foreign Application Priority Data

May 9, 1979 [JP] Japan ..... 54-55640
Aug. 28, 1979 [JP] Japan ..... 54-64938

[51] Int. Cl.[3] ..... D21H 5/12

[52] U.S. Cl. ..... 162/146; 162/157.2; 162/182; 162/192; 264/6; 264/14; 428/288; 428/364; 428/474.4

[58] Field of Search ..... 162/157.2, 157.4, 182, 162/192, 146; 428/288, 364, 474.4; 525/423, 426; 528/118; 264/6, 13, 14; 204/159.11

[56] References Cited

U.S. PATENT DOCUMENTS

| | | | |
|---|---|---|---|
| 2,940,953 | 6/1960 | Belanger | 528/118 |
| 2,947,725 | 8/1960 | Cooke | 528/118 |
| 2,999,788 | 9/1961 | Morgan | 162/157 R |
| 3,409,497 | 11/1968 | Roseland | 525/423 |
| 3,676,249 | 7/1972 | Lemelson | 264/211 |
| 3,734,887 | 5/1973 | Schmitt et al. | 525/423 |
| 3,756,908 | 9/1973 | Gross | 162/146 |
| 3,779,949 | 12/1973 | Porret et al. | 525/423 |
| 4,230,766 | 10/1980 | Gaussens et al. | 428/288 |

*Primary Examiner*—Peter Chin
*Attorney, Agent, or Firm*—Burgess, Ryan and Wayne

[57] ABSTRACT

An aromatic polyamide paper-like sheet having excellent heat- and chemical- resistances and electric insulating properties, comprises an artificial pulp ingredient comprising a number of amorphous pulp particles consisting of an aromatic polyamide material, and a fiber ingredient consisting of a number of short fibers bonded to each other with the amorphous pulp particles, the ratio in weight of the artificial pulp ingredient to the fiber ingredient being in a range of from 1:9 to 9:1 and the aromatic polyamide molecules contained at least in the amorphous pulp particles being cross-linked with a cross-linking agent.

20 Claims, No Drawings

AROMATIC POLYAMIDE PAPER-LIKE SHEET AND PROCESSES FOR PRODUCING THE SAME

This application is a continuation of application Ser. No. 341,540, filed Jan. 21, 1982, abandoned which is a continuation of Ser. No. 144,341 filed Apr. 28, 1980, abandoned.

FIELD OF THE INVENTION

The present invention relates to an artificial paper-like sheet and processes for producing the same. More particularly, the present invention relates to an aromatic polyamide paper-like sheet and processes for producing such a sheet.

BACKGROUND OF THE INVENTION

It is well-known that a large amount of paper is produced from natural cellulosic pulp. Also, it is known that artificial paper-like sheets produced from various synthetic polymer materials are used as electric insulating sheets due to the excellent heat resistance and electric insulating property thereof. The most important electric insulating sheets are those comprising, as a principal component, an aromatic polyamide material, because the aromatic polyamide exhibits an excellent heat resistance. For example, Japanese Patent Application Publication (Kokoku) No. 43-20421 (1968) discloses an artificial paper-like sheet made from a mixture of mica particles and fibrids of an aromatic polyamide material which are substantially not melted and which are entangled with each other and with the mica particles, which sheet is useful as an electric insulating sheet having an excellent heat resistance. However, the conventional aromatic polyamide paper-like sheets are unsatisfactory not only in heat-resistance, for example, dimensional stability at an elevated temperature, but also, in the electric insulating property, for example, dielectric breakdown strength.

Under the above-mentioned circumstances, it is strongly desired to provide an aromatic polyamide paper-like sheet having excellent heat resistance and electric insulating properties.

DISCLOSURE OF THE INVENTION

An object of the present invention is to provide an aromatic polyamide paper-like sheet having excellent heat resistance and electric insulating properties, together with excellent mechanical properties and resistance to chemicals, and processes for producing the same.

The above-mentioned object can be attained by the aromatic polyamide paper-like sheet of the present invention, which comprises an aromatic polyamide artificial pulp ingredient comprising a number of amorphous particles consisting of at least one aromatic polyamide material and a fiber ingredient consisting of a number of short fibers bonded to each other with said artificial pulp ingredient, the ratio in weight of sad artificial pulp ingredient to said fiber ingredient being in a range of from 1:9 to 9:1, and the aromatic polyamide molecules in said artificial pulp ingredient being cross-linked with a cross-linking agent.

The above-specified aromatic polyamide paper-like sheet can be produced by a process of the present invention comprising the steps of:

dissolving at least one aromatic polyamide material and at least one cross-linking agent in an organic solvent to prepare a polymer solution;

gradually pouring said polymer solution into a coagulating liquid while vigorously stirring said coagulating liquid to prepare a number of amorphous particles consisting of said aromatic polyamide and said cross-linking agent;

separating said amorphous particles from said coagulating liquid to provide an artificial pulp ingredient;

suspending said artificial pulp ingredient together with a fiber ingredient comprising a number of short fibers in water, to prepare a slurry;

forming a precursory paper-like sheet from said slurry by a paper-making method, and;

cross-linking the molecules of said aromatic polyamide with said cross-linking agent in said precursory paper-like sheet by applying radiation of at least one member selected from ultraviolet rays, electron beams and heat to said precursory paper-like sheet.

The above-specified aromatic polyamide paper-like sheet can also be produced by a process of the present invention which comprises the steps of:

dissolving at least one aromatic polyamide material in an organic solvent to prepare a polymer solution;

gradually pouring said polymer solution into a coagulating liquid while vigorously stirring said coagulating liquid to prepare a number of amorphous particles consisting of said aromatic polyamide;

separating said amorphous particles from said coagulating liquid to provide an artificial pulp ingredient;

suspending said artificial pulp ingredient together with a fiber ingredient comprising a number of short fibers in water, to prepare a slurry;

forming a precursory paper-like sheet from said slurry by a paper-making method;

impregnating said paper-like sheet with a cross-bonding agent, and;

cross-linking the molecules of aromatic polyamide with said cross-linking agent in said precursory paper-like sheet by applying radiation of at least one member selected from ultraviolet rays and electron beams are heat to said precursory paper-like sheet.

DETAILED DESCRIPTION OF THE INVENTION

The aromatic polyamide paper-like sheet of the present invention comprises an artificial pulp ingredient comprising a number of amorphous particles consisting of at least one aromatic polyamide material and a fiber ingredient comprising a number of short fibers bonded to each other with the amorphous aromatic polyamide particles in the artificial pulp ingredient.

The term "aromatic polyamide material" used herein refers to a film-forming polymeric material which consists of an aromatic polyamide and exhibits a degree of solubility of 3% by weight or more, preferably, 5% by weight or more, in an amide type polar solvent, for example, N-methyl-2-pyrrolidone.

It is preferable that the aromatic polyamide contain at least 75 molar % of repeating units selected from the group consisting of those of the formulae (I) and (II):

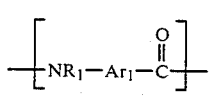

(I)

-continued and

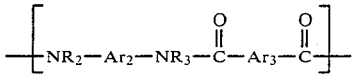

(II)

wherein $Ar_1$, $Ar_2$ and $Ar_3$ respectively present, independently from each other, an unsubstituted or substituted divalent aromatic radical which comprises a single aromatic ring, or two or more aromatic rings that are condensed together, or are linked together by a single bond, or by a bridging atom or radical, and which is oriented ether meta or para, and $R_1$, $R_2$ and $R_3$ respectively represent, independently from each other, a hydrogen atom or an alkyl radical having 1 to 3 carbon atoms.

In the formulae (I) and (II), it is preferable that $Ar_1$, $Ar_2$ and $Ar_3$ be respectively selected, independently from each other, from the group consisting of the radicals of the formulae:

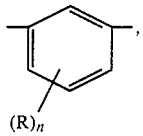

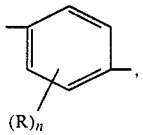

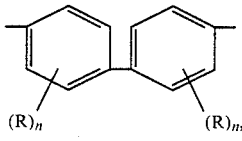

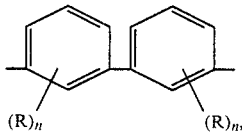

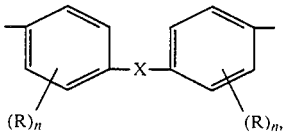

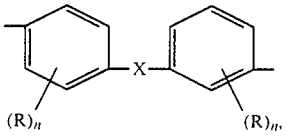

and

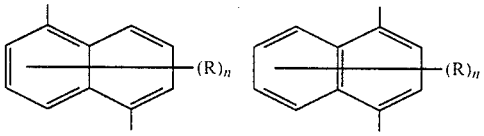

wherein R represents a member selected from the group consisting of lower alkyl radicals having 1 to 6 carbon atoms, lower alkoxy radicals having 1 to 6 carbon atoms, halogen atoms and a nitro radical, n represents zero or an integer of from 1 to 4 and X represents a member selected from the group consisting of

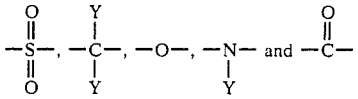

wherein Y represent a member selected from the group consisting of a hydrogen atom and lower alkyl radicals having 1 to 6 carbon atoms.

The aromatic polyamide usable for the present invention can be produced by any of the conventional polymerization methods, for instance, a solution polymerization method and an interface polymerization method, from an aromatic dicarboxylic acid chloride with an aromatic diamine or from an aromatic amino acid.

The short fibers usable for the present invention can be selected from inorganic short fibers, for instance, glass short fibers, asbesto and silica short fibers, and organic short fibers having excellent heat resistance and electric insulating property, for example, polyester short fibers and aromatic polyamide short fibers. It is preferable that the short fibers be made from an aromatic polyamide material which is usable for the artificial pulp ingredient. In this case, it is also preferable that the molecules of the aromatic polyamide short fibers in the paper-like sheet be cross-linked with the cross-linking agent. The short fibers preferably have a denier of from 0.5 to 10, more preferably, from 1.0 to 3.0, and a length of from 1 to 10 mm, more preferably, from 3 to 8 mm.

In the paper-like sheet of the present invention, the ratio in weight of the artificial pulp ingredient to the fiber ingredient is in a range of from 1:9 to 9:1, preferably, from 2:8 to 8:2. When the ratio is smaller than 1:9, the resultant paper-like sheet exhibits a poor electric insulating property, for example, a poor dielectric breakdown strength, and poor mechanical properties, for example, a poor tensile strength and ultimate elongation. Also, when the ratio is larger than 9:1, the resultant paper-like sheet exhibits a poor oil-impregnating property and poor mechanical properties, for instance, poor tensile strength and ultimate elongation.

The cross-linking agent usable for the present invention contains at least one cross-linking compound which may be selected from the group consisting of:

(A) organic cross-linking compounds containing at least one epoxy radical;

(B) organic cross-linking compounds having at least one radical selected from those of the formulae (B-I), and (B-II):

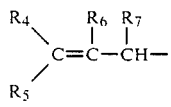

(B-I)

and

-continued

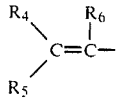

(B-II)

wherein $R_4$, $R_5$, $R_6$ and $R_7$ respectively represent, independently from each other, a hydrogen atom or an alkyl radical having 1 to 3 carbon atoms, and $R_4$ and $R_5$, $R_4$ and $R_6$, $R_5$ and $R_6$, or $R_6$ and $R_7$ may be fuse-bonded to form a ring which is not an aromatic ring, and;

(C) bis-maleimide cross-linking compounds of thhe formula (C-I):

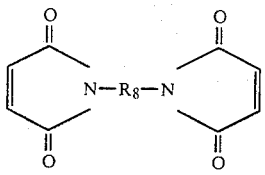

(C-I)

wherein $R_8$ represents an alkyl radical having 1 to 12 carbon atoms or an aryl radicals.

The above-specified cross-linking compounds (A), (B) and (C) are capable of forming cross-linkages having excellent resistances to heat and chemicals, between the molecules of the aromatic polyamide.

The cross-linking compound (A) may have at least two epoxy radical. In this case, the cross-linking compound (A) having two or more epoxy radicals may be selected from the group consisting of (1) bisphenol A type epoxy compounds of the formula (A-I):

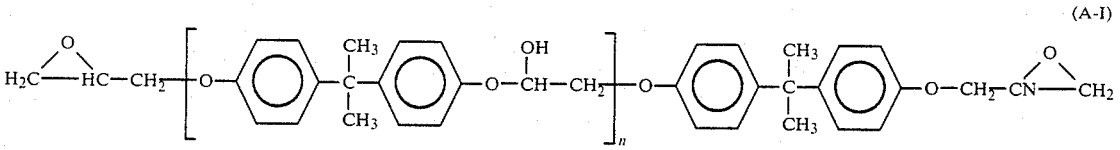

(A-I)

wherein n represents zero or an integer of from 1 to 3, and; (2) cyanurate and isocyanurate type epoxy compounds of the formulae (A-II) and (A-III):

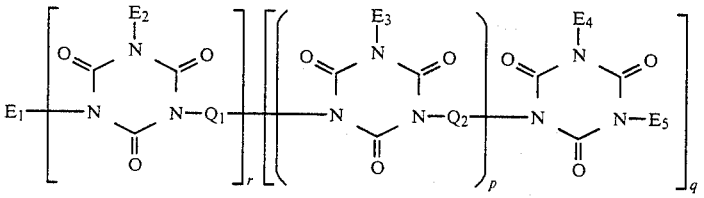

(A-II)

and

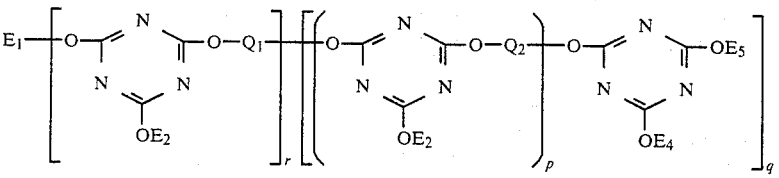

(A-III)

wherein $Q_1$ represents a di-, tri- or tetra-valent organic radical; $Q_2$ represents a single bond or a di- or more valent organic radical; at least two members of $E_1$ through $E_5$ respectively represent, independently from each other, a radical selected from those of the formulae (A-IV) and (A-V):

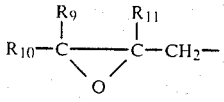

(A-IV)

and

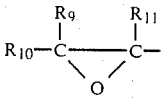

(A-V)

in which $R_9$, $R_{10}$, and $R_{11}$ respectively represent, independently from each other, a hydrogen atom or an organic radical, and the remaining members thereof respectively represent, independently from each other, a radical selected from those of the formulae (A-IV) and (A-V) and a monovalent radical corresponding to the radical represented by $Q_1$; r represents zero or 1; p represents zero or an integer of from 1 to 10, and; q represents an integer of from 1 to 3.

The cyanurate and isocyanurate type epoxy compounds of the formulae (A-II) and (A-III) may include tris(glycidyl)isocyanurate, di(glycidyl)methyl isocyanurate, di(glycidyl)ethyl isocyanurate, ethylene-bis(diglycidyl isocyanurate), oxydiethylene bis(diglycidyl isocyanurate), diglycidylallylisocyanurate, tris(glycidyl)cyanurate, di(glycidyl)methyl cyanurate, di(glycidyl)ethyl cyanurate, ethylenebis(glycidyl cyanurate), tetramethylene(diglycidyl cyanurate), oxydiethylene bis(diglycidyl cyanurate), and di(glycidyl)allylcyanurate.

The above-mentioned cyanurate and isocyanurate compounds can be prepared in accordance with the methods of, for example, Zn.Organ.Khim.2(10), 1742(1965); J.Am.Chem.Soc., 73, 3003(1951), and; Kunstoffe 55, 641(1965).

The cross-linking compound (B) may be selected from (1) amide and imide type compounds having at least one radical selected from those of the formulae (B-I) and (B-II), and; (2) cyanurate and isocyanurate type compounds having a formula selected from the formulae (B-III) and (B-IV):

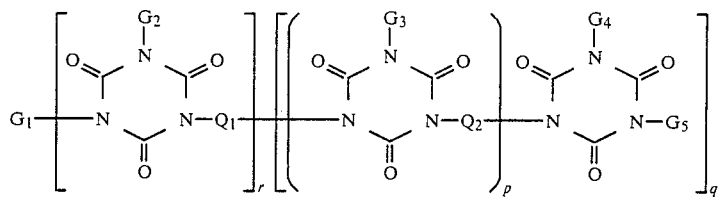

(B-III)

and

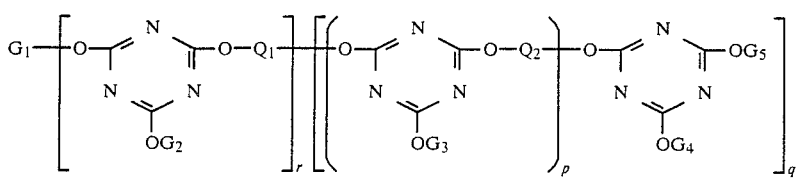

(B-IV)

wherein $Q_1$ represents a di-, tri- or tetra-valent organic radical; $Q_2$ represents a single bond or a di- or more valent organic radical; at least two members of $G_1$ through $G_5$ respectively represent, independently from each other, a radical selected from those of the formulae (B-I) and (B-II), and the remaining members thereof respectively represent, independently from each other; a radical selected from those of the formulae (B-I, and (B-II) and a monovalent radical corresponding to the radical represented by $Q_1$; r represents zero or 1; p represents zero or an integer of from 1 to 10, and; q represents an integer of from 1 to 3.

The above-specified amide and imide type cross-linking compounds may include N,N'-diallyladipic acid amide, N,N'-dimethallyl adipic acid amide, N,N'-dicrotyl adipic acid amide, N,N'-diallyl terephthalic acid amide, N,N'-diallyl isophthalic acid amide, N,N'-diallylnaphthalene carboxylic acid amide, N,N',N''-triallyl trimellitic acid amide, N,N,N',N'-tetraallyl adipic acid amide, N,N,N',N'-tetraallyl terephthalic acid amide, N,N-diallylbenzamide, N,N,N',N',N'',N''-hexallyl trimellitic acid amide, N,N,N',N',N'',N'',N''',N'''-octaallyl pyromellitic acid amide, N,N'-diallylbenzophenone-3,4,3',4'-tetracarboxylic acid bisamide, N,N'-diallylbutane-1,2,3,4-tetracarboxylic acid bisimide, ethylene bis(N-allyltrimellitic acid imide) amide, N,N'-diallyltrimellitic acid amide imide, ethylene bis(2-propylenecarboxyamide), N,N,N',N'-tetraallyl-3-hexene-1,6-dicarboxyamide, ethylene bis-2-cyclohexenecarboxyamide, ethylene bis-3-cyclohexene-1,2-dicarboxyimide, N-allyl-2-cyclohexane carboxyamide, N,N,N',N'-tetraallyl-3-cyclo-hexene-1,2-dicarboxyamide, and compounds of the formula:

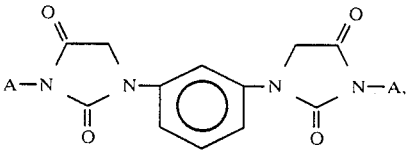

wherein A represents a radical of the formula selected from the formulae (B-I) and (B-II), that is, allyl, methallyl and crotyl radicals.

Also, the specified cyanurate and isocyanurate cross-linking agent of the formulae (B-III) and (B-IV) may include triallyl isocyanurate, diallylmethyl isocyanurate ethylene bis(diallyl isocyanurate), hexamethylene bis(-diallyl isocyanurate), oxydiethylene-bis(diallyl isocyanurate), polyethylene allyl isocyanurate having at least one terminal radical consisting of a diallyl isocyanurate residue, polypropylene allyl isocyanurate having at least one terminal radical consisting of a diallyl isocyanurate residue, polytetramethyleneallyl isocyanurate having at least one terminal radical consisting of a diallyl isocyanurate radical, triallyl cyanurate, diallylmethyl cyanurate, ethylene bis(diallyl cyanurate), hexamethylene bis(diallyl cyanurate), hexamethylene bis(diallyl cyanurate), oxydiethylene bis(diallylcyanurate), polytertramethylene allyl cyanurate having at least one terminal radical consisting of a diallyl cyanurate residue and polyhexamethylene allyl cyanurate having at least one terminal radical consisting of a diallyl cyanurate residue.

The cross-linking compound (B) having the radicals of the formulae (B-I) and/or (B-II) may be triacryl formal, trivinyl cyanurate or tripentenyl cyanurate.

The bis-maleimide cross-linking compound (C) may be selected from N,N'-ethylene bismaleimide, N,N'-m-phenylene bismaleimide, N,N'-p-phenylene bismaleimide, N,N'-4,4'-diphenylmethane bismaleimide, N,N'-4,4'-diphenylether bismaleimide, N,N'-4,4'-diphenylsulfone bismaleimide, N,N'-m-xylylene bismaleimide and N,N'-p-xylylene bismaleimide.

In the paper-like sheet of the present invention, the cross-linking agent is usually used in an amount of 10% or less based on the entire weight of the aromatic polyamide material contained in the paper-like sheet.

The aromatic polyamide paper-like sheet of the present invention may contain a solid inorganic additive, in addition to the pulp ingredient and the fiber ingredient. The solid inorganic additive may be selected from mica, asbesto, glass flakes, quartz powder, talc, kaoline, and alumina, which are effective for enhancing the oil-absorbing property, heat resistance and electric insulating property of the resultant paper-like sheet and the paper-making property of the slurry. Usually, the solid inorganic additive is used in an amount of from 5 to 400%, preferably, from 10 to 200%, based on the weight of the artificial pulp ingredient.

In the aromatic polyamide paper-like sheet of the present invention, the aromatic polyamide material in the pulp ingredient and, optionally, the aromatic polyamide fibers in the fiber ingredient are cross-linked with the cross-linking agent, and, therefore, exhibit excellent resistance to heat and organic solvents, for example, N-methyl-2-pyrrolidone, N,N-dimethyl formamide and N,N-dimethyl acetamide, and an excellent electric insulating property. It is important that the above-mentioned excellent properties can be obtained without causing the mechanical properties of the paper-like sheet to be deteriorated.

It is known from, for example, U.S. Pat. No. 3,287,324, that before being heat-treated, m-phenylene isophthalamide type polymers are soluble in an amide type polar solvent such as N-methyl-2-pyrrolidone, N,N-dimethyl formamide or N,N-dimethyl acetamide. However, the heat treatment causes the polymers to become insoluble in the solvent. The soluble type of polymer is referred to as a $\alpha$-type m-phenylene isophthalamide type polymer and the insoluble type of polymer is referred to as a $\beta$-type m-phenylene isophthalamide type polymer. It is also known that the $\beta$-type polymer is soluble in a solution of a salt such as lithium chloride or calcium chloride in the amide type polar solvent.

However, in the case of the aromatic polyamide paper-like sheet of the present invention, the aromatic polyamide material contained therein is substantially insoluble in the solution of the salt in the amide type polar solvent, because the aromatic polyamide material is cross-linked. Furthermore, both the $\alpha$-type and $\beta$-type m-phenylene-isophthalamide polymers can be completely dissolved in a concentrated sulfuric acid. However, when the cross-linked paper-like sheet of the present invention is immersed in the concentrated sulfuric acid, 5% by weight or more of the paper-like sheet can be retained in the non-dissolved state.

In a process for producing the aromatic polyamide paper-like sheet of the present invention, an aromatic polyamide material and a cross-linking agent are dissolved in an organic solvent to prepare a polymer solution. The organic solvent is usually selected from amide type polar solvents, for instance, N-methyl-2-pyrrolidone, N,N-dimethyl formamide and N,N-dimethyl acetamide.

The content of the aromatic polyamide material in the polymer solution is variable depending on the type of and degree of polymerization of the aromatic polyamide material, and type of the solvent. However, usually, it is preferable that the content of the aromatic polyamide material in the polymer solution be in a range of from 2 to 15% based on the entire weight of the polymer solution. Also, it is preferable that the amount of the cross-linking agent in the polymer solution be in a range of from 0.1 to 10%, based on the weight of the aromatic polyamide material. Furthermore, the polymer solution may contain 1 to 10%, preferably, from 3 to 9%, of water based on the entire wieght of the polymer solution.

The polymer solution is brought into contact with a coagulating liquid while vigorously stirring the coagulating liquid to prepare a number of amorphous particles of a coagulated mixture of the aromatic polyamide material with the cross-linking agent. The coagulating liquid is not limited to one having a specific composition, as long as the coagulating liquid is effective for coagulating the mixture of the aromatic polyamide material with the cross-linking agent therefrom. Usually, it is preferable that the coagulating liquid consist of an aqueous solution of 10 to 48% by weight, more preferably, 30 to 45% by weight, of N-methyl-2-pyrrolidone. The coagulating liquid preferably has a temperature of 5° to 80° C., more preferably, 35° to 45° C. When the polymer solution is brought into contact with the coagulating liquid, the coagulating liquid is vigorously stirred to an extent sufficient for rapidly removing the organic solvent from the drops of the polymer solution, so as to cause the coagulation of the mixture of the aromatic polyamide material with the cross-linking agent, and for vigorously shearing and beating the drops of the polymer solution and the resultant particles of the coagulated mixture, so as to form a number of amorphous particles.

The resultant amorphous particles are separated from the coagulating liquid to provide an artificial pulp ingredient, by means of, for instance, filtration or centrigugation. The artificial pulp ingredient and a fiber ingredient comprising a number of short fibers are suspended in water to prepare a slurry. In this case, the ratio in weight of the artificial pulp ingredient to the fiber ingredient is in a range of from 1:9 to 9:1.

The slurry is subjected to a paper-making method to prepare a precursory paper-like sheet. The paper-making method is not limited to a specific type of method. However, a preferable paper-making method is a wet paper-making method using a long net type or circular net type paper-making machine.

The precursory paper-like sheet is subjected to a cross-linking procedure in which heat, ultraviolet rays and/or electron beams are applied to the precursory paper-like sheet to as to cross-link the molecules of the aromatic polyamide in the sheet. When heat is applied, it is preferable that the precursory paper-like sheet be heated at a temperature of from 110° to 360° C., more preferably, from 150° to 330° C. However, the cross-linking temperature is variable depending on the types of the cross-linking agent and the aromatic polyamide, degrees of crystallinity and polymerization of the polymers in the artificial pulp ingredient and the fiber ingredient. When ultra-violet rays are applied, it is preferable that an ultra-violet ray source having an output of from 0.5 to 5 KW be spaced 1 to 100 cm from the precursory paper-like sheet. The radiation of ultra-violet rays is preferably carried out for 10 to 1000 seconds. The application of ultra-violet rays can be carried out concurrently with or before the application of heat to the precursory paper-like sheet. In this case, it is preferable that the precursory paper-like sheet be heated at a temperature of from 110° to 360° C. Also, in order to accelerate the cross-linking reaction, a photosensitizer, for example, benzophenone, may be contained in the precursory paper-like sheet.

When electron beams are utilized for the cross-linking operation, it is preferable that the eletron beams be applied at a dose of 0.5 Mrad or more to the precursory paper-like sheet. In this case, the application of the electron beams may be carried out concurrently with or before the application of heat to the precursory paper-like sheet. The precursory paper-like sheet is preferably heated at a temperature of from 110° to 360° C.

After or during the cross-linking operation, the paper-like sheet may be pressed under a pressure of 400 kg/cm$^2$ or less, by using a presser or nip rollers. The pressing operation may be carried out while heating the paper-like sheet at a desired temperature, preferably, from 110° to 360° C.

In another process for producing the aromatic polyamide paper-like sheet of the present invention, an artificial pulp ingredient is prepared from a polymer solution containing an aromatic polyamide material and no cross-linking agent. The artificial pulp ingredient containing no cross-linking agent is suspended together with a fiber ingredient in water. The resultant slurry is used for producing a precursory paper-like sheet. Thereafter, the precursory paper-like sheet is impregnated with a cross-linking agent by applying a solution of the cross-linking agent thereto by means of spray, immersion or coating. The precursory paper-like sheet impregnated with the cross-linking agent is subjected to the cross-linking operation as described above. This type of process is effective when the cross-linking agent is very soluble in the organic solvent for preparing the polymer solution and, therefore, it is difficult to retain a desired amount of the cross-linking agent in the artificial pulp ingredient.

In the processes of the present invention, the cross-linking operation is effective for enhancing the resistance of the paper-like sheet to heat and chemicals, and the electric insulating property of the paper-like sheet, without deteriorating the mechanical properties, for example, the tensile strength, of the paper-like sheet. The cross-linkage is especially effective for reinforcing the combination (entanglement) of the pulp particles and the short fibers in the paper-like sheet. The reinforced combination is also effective for enhancing the heat-resistance of the paper-like sheet.

The heat treatment which is applied to the precursory paper-like sheet during or before the cross-linking operation causes the cross-linking agent to be melted. The melted cross-linking agent serves as a plasticizer for the artificial pulp particles and increases the density of the artificial pulp particles in the paper-like sheet. This increase in the density of the artificial pulp particles is effective for enhancing the electric insulating properties such as the dielectric breakdown strength, of the paper-like sheet of the present invention.

The aromatic polyamide paper-like sheet of the present invention is useful in various fields, for example, as a heat-resistant insulating material, F.P.C. substrate film and film for data processing business.

The specific examples set forth below are presented for the purpose of clarifying the present invention. However, it should be understood that these are intended only to be examples of the present invention and are not intended to limit the present invention in any way.

In the examples, the amount of a portion of the paper-like sheet not dissolved in a concentrated sulfuric acid was determined in the following manner.

300 mg of a paper-like sheet was placed in a dissolving tube with a stirrer. 20 ml of a 98% concentrated sulfuric acid was placed in the dissolving tube and stirred at a temperature of 25° C., for 3 hours, to treat the paper-like sheet. Thereafter, the treated paper-like sheet was separated from the concentrated sulfuric acid by using a glass filter, washed with water and, then, dried. The weight of the dried paper-like sheet was determined. The non-dissolved amount A in % of the paper-like sheet was calculated from the equation:

$$A(\%) = W_1/W_0 \times 100$$

wherein $W_0$ represents a dry weight of the non-treated paper-like sheet and $W_1$ represents a dry weight of the treated paper-like sheet.

The amount of a portion of the paper-like sheet not dissolved in a solution of lithium chloride in N-methyl-2-pyrrolidone was determined in the same manner as that mentioned above, except that a solution of 4.5% by weight of lithium chloride in N-methyl-2-pyrrolidone was used instead of the concentrated sulfuric acid and the treatment was carried out at a temperature of 75° C. for 3 hours. The non-dissolved amount B in % of the paper-like sheet was calculated from the equation:

$$B(\%) = W_2/W_0 \times 100$$

wherein $W_0$ is as defined above, and $W_2$ represents a dry weight of the treated paper-like sheet.

The amount of a portion of the paper-like sheet not dissolved in N-methyl-2-pyrrolidone was determined in the same manner as that mentioned above, except that N-methyl-2-pyrrolidone alone was used in place of the lithium chloride solution and the treatment was carried out at a temperature of 75° C. for three hours. The non-dissolved amount C (%) of the paper-like sheet was calculated from the equation:

$$C(\%) = W_3/W_0 \times 100$$

wherein $W_0$ is as defined above and $W_3$ represent a dry weight of the treated paper-like sheet.

The dielectric breakdown strength of the paper-like sheet was determined in accordance with Japanese Industrial Standard C 2111 by using an AC voltage.

The shrinkage of the paper-like sheet was measured by heating the sheet at a temperature of 300° C. for 24 hours. The shrinkage D (%) of the paper-like sheet was calculated from the equation:

$$D(\%) = (L_0 - L_1)/L_0 \times 100$$

wherein $L_0$ represents a length between two points marked on the non-heated paper-like sheet and $L_1$ represents a length between the marked two points on the heated paper-like sheet.

The stability in form of the paper-like sheet was determined by immersing a piece of the paper-like sheet having a width of 5 mm and a length of 50 mm in an 85% sulfuric acid, at a temperature of 25° C. for 24 hours, washing the immersed piece, drying the washed piece, and then, observing the dried piece by the naked eye.

EXAMPLES 1 THROUGH 4

In each of Examples 1 through 4, a polymer solution was prepared by uniformly dispersing (1) 60 parts by weight of a poly-m-phenylene isophthalamide powder which had been prepared by an interface polymerization method and which exhibited an intrinsic viscosity of 1.35, determined in N-methyl-2-pyrrolidone, at a concentration of 0.5 g/dl, and (2) 3 parts by weight of a cross-linking agent as indicated in Table 1, in a mixture solvent which had been prepared from 940 parts by weight of N-methyl-2-pyrrolidone and 60 parts by weight of water, and which had been cooled to a temperature of about 5° C., and; by heating the dispersion to a temperature of about 50° C. A coagulating liquid was prepared by mixing 35% by weight of N-methyl-2-pyrrolidone with 65% by weight of water and, then, cooling the mixture to a temperature of 39° C.

In order to bring the polymer solution into contact with the coagulating liquid, a tube type continuous coagulating apparatus, having a stirrer, which was provided with a combination of a stator having a baffle and a turbine paddle type rotor having two paddles, and was provided with an inlet for feeding the polymer solution and the coagulating liquid, and an outlet for discharging the resultant slurry containing the artificial pulp particles, was used. The polymer solution and the coagulating liquid were concurrently fed through the inlet into the coagulating apparatus at feed rates of 0.5 kg/min and 5 kg/min, respectively, while vigorously stirring the mixture at a rotation rate of 7100 rpm of the rotor. The resultant slurry of the coagulated artificial pulp particles was discharged from the outlet. The slurry was filtered by using a Nutsche type filter to separate the coagulated artificial pulp particles from the coagulating liquid. The artificial pulp articles were washed with ion-exchanged water. The washed pulp articles in a dry weight of 1.2 g were suspended together with 0.8 g of a fiber ingredient consisting of a poly-m-phenylene isophthalamide short fibers, each having a denier of 1.5 and length of 7 mm, in 1 liter of water, to prepare an aqueous slurry. A precursory paper-like sheet was made from the aqueous slurry by using a Tappi Standard Sheet Machine. The paper-making operation could be carried out without difficulty and the resultant sheet had a satisfactory quality. The precursory paper-like sheet was dried and, then, heated at a temperature of 270° C. while pressing it under a pressure of 200 kg/cm$^2$. The resultant paper-like sheet a weight of 110 g/m$^2$ and a thickness of 100 microns.

The properties of the paper-like sheet are indicated in Table 1.

EXAMPLES 5 THROUGH 8

In Examples 5 through 8, the same procedures respectively as those described in Examples 1 through 4 were carried out, except that in each example, the cross-linking agent as indicated in Table 1 was not contained in the polymer solution and the dried precursory paper-like sheet was immersed in a solution of 3% by weight of the cross-linking agent in tetrahydrofuran (THF), at room temperature, for 10 minutes and, then, air dried to completely evaporate away THF. The cross-linking agent-containing precursory paper-like sheet was heated at a temperature of 270° C. while pressing it under a pressure of 200 kg/cm$^2$. The resultant paper-like sheet in each example had a weight of 110 g/m$^2$ and a thickness of 100 microns, and exhibited properties as indicated in Table 1.

COMPARISON EXAMPLE 1

The same procedures as those described in Example 1 were carried out, except that no cross-linking agent was used. The resultant comparative paper-like sheet had a weight of 110 g/m$^2$ and a thickness of 100 microns, and exhibited the properties as indicated in Table 1.

TABLE 1

| Example No. | Cross-linkage agent | Amount(A) of non-dissolved portion in $H_2SO_4$ (wt. %) | Shrinkage D at 300° C./24 hr (%) | Tensile strength (kg/mm) | Ultimate elongation (%) | Dielectric breakdown strength (KV/mm) | Stability in form in 85% $H_2SO_4$ |
|---|---|---|---|---|---|---|---|
| 1 | Tris(glycidyl)isocyanurate | 35 | 0.8 | 8.9 | 10.9 | 56 | Excellent |
| 2 | Di(glycidyl)allylisocyanurate | 27 | 1.3 | 7.9 | 11.2 | 53 | Good |
| 3 | Tris(glycidyl)cyanurate | 39 | 0.9 | 8.8 | 10.5 | 56 | Excellent |
| 4 | Di(glycidyl)allylcyanurate | 24 | 1.7 | 7.5 | 11.4 | 53 | Good |
| 5 | Tris(glycidyl)isocyanurate | 32 | 0.9 | 8.5 | 9.8 | 54 | Excellent |
| 6 | Di(glycidyl)allylisocyanurate | 27 | 1.5 | 8.0 | 8.9 | 50 | Good |
| 7 | Tris(glycidyl)cyanurate | 36 | 0.7 | 8.7 | 9.5 | 50 | Excellent |
| 8 | Di(glycidyl)allylcyanurate | 25 | 1.8 | 7.9 | 8.5 | 50 | Good |
| Comparison Example 1 | None | 0 | 5.1 | 6.1 | 7.0 | 34 | Poor |

EXAMPLE 9 AND COMPARISON EXAMPLE 2

In Example 9, the same procedures as those described in Example 1 were carried out, except that the polymer solution contained no cross-linking agent, and after the precursory paper-like sheet was dehydrated at room temperature, the precursory sheet was immersed in an aqueous solution containing 0.25% by weight of tris(glycidyl)isocyanurate (TGIC) for a time sufficient to completely replace water in the precursory sheet by the TGIC aqueous solution, and then, dried. The resultant cross-linking agent-containing precursory sheet was heated at a temperature of 270° C. while pressing it under a pressure of 200 kg/cm$^2$. The resultant paper-like sheet had a weight of 110 g/m$^2$ and thickness of about 100 microns, and exhibited the properties as indicated in Table 2. In Comparison Example 2, the same procedures as those described in Example 9 were carried out, except that no tris(glycidyl)isocyanurate was used. The results are indicated in Table 2.

TABLE 2

| Item | Example 9 | Comparison Example 2 |
|---|---|---|
| Amount(A) of non-dissolved portion in 98% $H_2O$ (%) | 40 | 0 |
| Amount(B) of non-dissolved portion in LiCl—NMP solution (%) | 52 | 0 |
| Amount(C) of non-dissolved portion in NMP (%) | 98 | 39 |
| Dielectric breakdown strength (KV/mm) | 51 | 35 |
| Tensile strength at room temperature (kg/mm$^2$) | 7.9 | 7.0 |
| Ultimate elongation at room temperature (%) | 14.5 | 18.0 |
| Tensile strength at 200° C. (kg/mm$^2$) | 5.6 | 4.2 |

TABLE 2-continued

| Item | Example 9 | Comparison Example 2 |
|---|---|---|
| Ultimate elongation at 200° C. (%) | 18.5 | 21.4 |
| Ratio, $\frac{\text{(tensile strength at 200° C.)}}{\text{(tensile strength at room temperature)}}$ (%) | 70.0 | 60.0 |

EXAMPLE 10

The same procedures as those described in Example 9 were carried out, except that the resultant heat-pressed paper-like sheet was subjected to a radiation of ultraviolet rays from a high voltage mercury lamp having an output of 2 KW and spaced 15 cm from the paper-like sheet, for 3 minutes. The resultant paper-like sheet exhibited an amount (A) of the non-dissolved portion thereof in a 98% $H_2SO_4$ of 51%, an amount (B) of the non-dissolved portion thereof in a LiCl-NMP solution of 60% and an amount (C) of the nondissolved portion thereof in a NMP of 100%.

EXAMPLE 11

The same procedures as those mentioned in Example 9 were carried out, except that the resultant heat-pressed paper-like sheet was subjected to a radiation of an electron beam, at a dose of 5 Mrad, by using a Hipertoron 30 EBCA-300A type electron beam radiation apparatus. The resultant paper-like sheet exhibited an amount (A) of non-dissolved portion thereof in a 98% $H_2SO_4$ of 45%.

EXAMPLES 12 THROUGH 17

In each of Examples 12 through 17, the same procedures as those mentioned in Example 9 were carried out, except that a cross-linking agent of the type indicated in Table 3 was used in the amount as indicated in Table 3. When the cross-linking agent was insoluble or slightly soluble in water, acetone was used as a solvent for the cross-linking agent. The results are shown in Table 3.

TABLE 3

| Example No. | Cross-linking agent Type | Amount* (%) | Non-dissolved amount (%) A (98% $H_2SO_4$) | B (LiCl-NMP solution) | C (NMP) |
|---|---|---|---|---|---|
| 12 | Tris(glycidyl) cyanurate | 3 | 41 | 51 | 97 |
| 13 | Di(glycidyl) allylcyanurate | 5 | 40 | 49 | 93 |
| 14 | Di(glycidyl) allyl-isocyanurate | 5 | 41 | 45 | 89 |
| 15 | m-phenylene bis-maleimide | 5 | 32 | 43 | 90 |
| | Hexamethylene bis-(diallyliso- | 3 | 40 | 42 | 95 |

TABLE 3-continued

| Example No. | Cross-linking agent Type | Amount* (%) | Non-dissolved amount (%) A (98% $H_2SO_4$) | B (LiCl-NMP solution) | C (NMP) |
|---|---|---|---|---|---|
| | cyanurate) | | | | |
| 16 | Tris(glycidyl)-isocyanurate | 1 | 40 | 46 | 92 |
| 17 | Hexaallylmel-amine | 5 | 43 | 47 | 97 |

Note:
*Amount in % based on the entire weight of percursory paper-like sheet

EXAMPLES 18 THROUGH 21

In each of Examples 18 through 21, the same procedures as those described in Example 9 were carried out, except that the cross-linking agent (TGIC) was applied in the amount as indicated in Table 4 to the precursory paper-like sheet. The properties of the resultant sheet are indicated in Table 4.

TABLE

| Example No. | Amount* of TGIC (%) | Thickness (micron) | Tensile strength (kg/mm$^2$) | Ultimate elongation (%) | Dielectric breakdown strength (KV/mm) | Non-dissolved amount (A) in 98% $H_2SO_4$ (%) |
|---|---|---|---|---|---|---|
| 18 | 5.3 | 114 | 10.7 | 12.4 | 54 | 59 |
| 19 | 2.8 | 115 | 10.0 | 14.3 | 54 | 52 |
| 20 | 1.4 | 112 | 9.5 | 17.4 | 52 | 40 |
| 21 | 0.6 | 119 | 8.4 | 17.1 | 55 | 33 |

Note:
*Amount in % based on entire weight of precursory paper-like sheet

EXAMPLES 22 THROUGH 25

Aromatic polyamide short fibers having a denier of 2 and a length of 5 mm were produced from a mixture of 95% by weight of poly-m-phenylene isophthalamide and 5% by weight of tris(glycidyl)isocyanurate (TGIC). In each of Examples 22 through 25, the same procedures as those described in Example 9 were carried out, except that the fiber ingredient consisted of the above-mentioned, TGIC-containing short fibers, and the precursory paper-like sheet was impregnated with an aqueous solution containing TGIC in the concentration as indicated in Table 5. The properties of the resultant paper-like sheet are indicated in Table 5.

TABLE 5

| Example No. | Concentration of TGIC (w %) | Non-dissolved amount in 98% $H_2SO_4$ (%) | Non-dissolved amount in LiCl/NMP solution (%) | Non-dissolved amount in NMP (%) |
|---|---|---|---|---|
| 22 | 0.1 | 85 | 90 | 95 |
| 23 | 0.25 | 87 | 90 | 98 |
| 24 | 0.5 | 90 | 93 | 100 |
| 25 | 4.0 | 90 | 95 | 100 |

We claim:

1. A process for producing an aromatic polyamide paper-like sheet, comprising the steps of:

dissolving in an organic solvent an aromatic polyamide material together with a cross-linking agent comprising at least one compound selected from the group consisting of (A) cyanurate and isocyanurate type epoxy compounds of the formula (A-II) and (A-III):

(A-II)

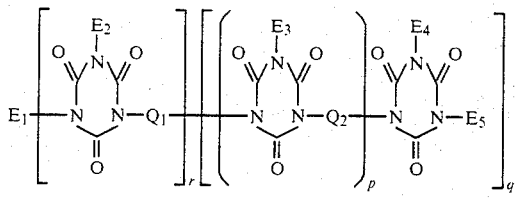

and (A-III)

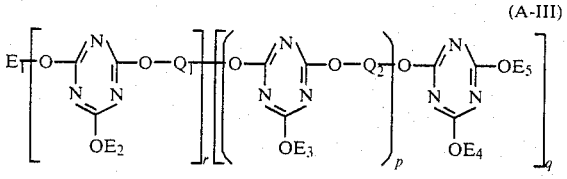

wherein $Q_1$ represents a di-, tri- or tetra-valent organic radical $Q_2$ represents a single bond or a di- or more valent organic radical; at least two members of $E_1$ through $E_5$ respectively represent, independently from each other, a radical selected from those of the formulae (A-IV) and (A-V):

(A-IV)

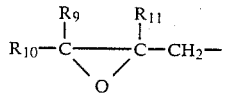

and (A-V)

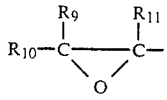

in which $R_9$, $R_{10}$, and $R_{11}$ respectively represent, independently from each other, a hydrogen atom or an organic radical, and the remaining members thereof respectively represent, independently from each other, a radical selected from those of the formulae (A-IV) and (A-V) and a monovalent radical corresponding to the radical represented by $Q_1$; r represents zero or 1; p represents zero or an integer of from 1 to 10, and; q represents an integer of from 1 to 3;

bringing said polymer solution into contact with a coagulating liquid while vigorously stirring said coagulating liquid to prepare a number of amorphous particles of a mixture of said aromatic polyamide material with said cross-linking agent;

separating said amorphous particles from said coagulating liquid to provide an artificial pulp;

suspending said artificial pulp together with a fiber comprising a number of short fibers in water, to prepare a slurry by which the ratio in weight of said artificial pulp to said fiber is in a range of from 1:9 to 9:1;

forming a precursory paper-like sheet from said slurry by a paper-making method, and;

cross-linking the molecules of said aromatic polyamide with said cross-linking agent in said precursory paper-like sheet by applying radiation of at least one member selected from ultraviolet rays and electron beams or heat to said precursory paper-like sheet.

2. An aromatic polyamide paperlike sheet produced by the process of claim 1, wherein said aromatic polyamide material comprises at least one aromatic polyamide containing at least 75 molar % of repeating units selected from the group consisting of those of the formulae (I) and (II):

(I)

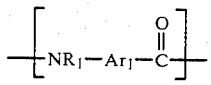

and (II)

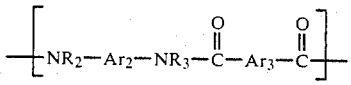

wherein $Ar_1$, $Ar_2$ and $Ar_3$ respectively represent, independently from each other, an unsubstituted or substituted divalent aromatic radical which comprises a single aromatic ring, or two or more aromatic rings that are condensed together, or are linked together bly a single bond, or by a bridging atom or radical, and which is oriented either meta or para, and $R_1$, $R_2$ and $R_3$ respectively represent, independently from each other, a hydrogen atom or an alkyl radical having 1 to 3 carbon atoms.

3. An aromatic polyamide paper-like sheet as claimed in claim 2, wherein said $Ar_1$, $Ar_2$ and $Ar_3$ in said formulae (I) and (II) are respectively selected, independently from each other, from the group consisting of the radicals of the formulae:

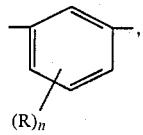

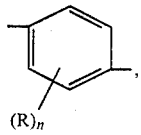

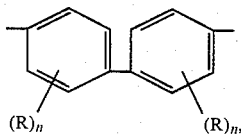

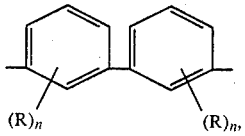

-continued

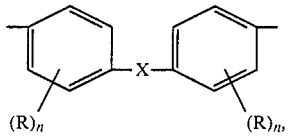

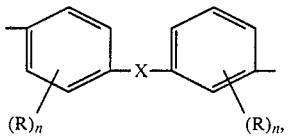

and

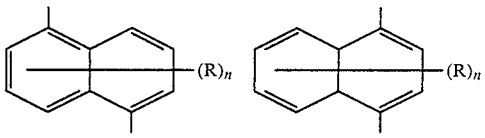

wherein R represents a member selected from the group consisting of lower alkyl radicals having 1 to 6 carbon atoms, lower alkoxy radicals having 1 to 6 carbon atoms, halogen atoms and a nitro radical, n represents zero or an integer of from 1 to 4 and X represents a member selected from the group consisting of:

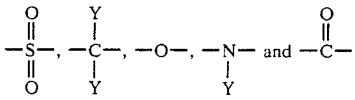

wherein Y represents a member selected from the group consisting of a hydrogen atom and lower alkyl radicals having 1 to 6 carbon atoms.

4. An aromatic polyamide paper-like sheet as claimed in claim 1, wherein said short fibers are inorganic fibers selected from glass fibers, asbestos, and silica fibers.

5. An aromatic polyamide paper-like sheet as claimed in claim 1 wherein said short fibers are organic fibers selected from aromatic polyamide fibers.

6. An aromatic polyamide paper-like sheet as claimed in claim 5, wherein the aromatic polyamide molecules in said short aromatic polyamide fibers are also cross-linked with said cross-linking agent.

7. An aromatic polyamide paperlike sheet produced by the process of claim 1, wherein said short fibers each have a denier of from 0.5 to 10.

8. An aromatic polyamide paperlike sheet produced by the process of claim 1, wherein said short fibers each have a length of from 1 to 10 mm.

9. An aromatic polyamide paper-like sheet produced by the process of claim 1, wherein said cross-linking agent is used in an amount of 10% or less based on the entire weight of said aromatic polyamide material contained in said paper-like sheet.

10. A process as claimed in claim 1, wherein said organic solvent is selected from amide type organic solvents.

11. A process as claimed in claim 10, wherein said amide type organic solvent is selected from the group consisting of N-methyl-2-pyrrolidone, N-N-dimethylformamide and N,N-dimethyl acetamide.

12. A process as claimed in claim 1, wherein the content of said aromatic polyamide material in said polymer solution is in a range of from 2 to 15% based on the entire weight of said polymer solution.

13. A process as claimed in claim 1, wherein said polymer solution contains 1 to 10% of water based on the entire weight of said polymer solution.

14. A process as claimed in claim 1, wherein the amount of said cross-linking agent in said polymer solution is in a range of from 0.1 to 10% based on the weight of said aromatic polyamide material.

15. A process as claimed in claim 1, wherein said coagulating liquid consists of an aqueous solution of 10 to 48% by weight of N-methyl-2-pyrrolidone.

16. A process as claimed in claim 1, wherein said coagulating liquid has a temperature of from 5° to 80° C.

17. A process as claimed in claim 1, wherein said cross-linking operation is carried out by applying ultra-violet rays from an ultra-violet ray source having an output of from 0.5 to 5 KW to said precursory paper-like sheet spaced 1 to 100 cm from said source, for 10 to 1,000 seconds.

18. A process as claimed in claim 1 wherein said cross-linking operation is carried out by applying an electron beam to said precursory paper-like sheet at a dose of 0.5 Mrad or more.

19. A process as claimed in claim 1, wherein said cross-linking operation is carried out by heating said precursory paper-like sheet at a temperature of from 110° to 360° C.

20. A process as claimed in claim 1, wherein after or during said cross-linking operation, said paper-like sheet is pressed under a pressure of 400 kg/cm$^2$ or less.

* * * * *